US006434824B1

(12) United States Patent
Pascolini et al.

(10) Patent No.: US 6,434,824 B1
(45) Date of Patent: Aug. 20, 2002

(54) PROCESS FOR MAKING A FLUID-TIGHT CONNECTION BETWEEN A TUBE AND A PLATE-SHAPED PART

(75) Inventors: Mauro Pascolini, Cividale del Friuli (IT); Bjorn Vestergaard, Aabenraa; Edward James Morley, Toftlund, both of (DK)

(73) Assignee: Norsk Hydro A.S., Oslo (NO)

( * ) Notice: Subject to any disclaimer, the term of this patent is extended or adjusted under 35 U.S.C. 154(b) by 0 days.

(21) Appl. No.: 09/647,225

(22) PCT Filed: Mar. 31, 1998

(86) PCT No.: PCT/EP98/01937

§ 371 (c)(1),
(2), (4) Date: Nov. 22, 2000

(87) PCT Pub. No.: WO99/50004

PCT Pub. Date: Oct. 7, 1999

(51) Int. Cl.[7] ..... B23P 15/26
(52) U.S. Cl. ..... 29/890.043; 29/890.031; 29/727
(58) Field of Search ..... 29/890.043, 890.044, 29/890.03, 890.031, 33 G; 72/62, 393

(56) References Cited

U.S. PATENT DOCUMENTS 5,117,548 A * 6/1992 Griffith et al. ..... 29/890.031
5,467,818 A * 11/1995 Buckley, Jr. ..... 165/176
5,806,173 A * 9/1998 Honma et al. ..... 29/727
5,992,198 A * 11/1999 Blangetti et al. ..... 72/62
6,016,681 A * 1/2000 Kenning ..... 72/393
6,183,503 B1 * 2/2000 Hart et al. ..... 623/1.51
6,065,664 A * 5/2000 Garner et al. ..... 29/447
6,178,636 B1 * 1/2001 Kroger et al. ..... 29/890.044
6,183,443 B1 * 2/2001 Kratoska et al. ..... 604/164.03

* cited by examiner

*Primary Examiner*—I Cuda Rosenbaum
(74) *Attorney, Agent, or Firm*—Gary M. Hartman; Domenica N. S. Hartman

(57) ABSTRACT

A process for making a fluid-tight connection between a tube and a plate-shaped member. The process entails inserting one end of a tube into a correspondingly-sized hole in a plate-shaped member so that the tube end contacts the plate-shaped member and extends beyond a surface of the plate-shaped member. A mandrel is then inserted and pressed into the tube end while heating the mandrel to a temperature sufficient to soften and deform the tube end and increase contact between the tube end and the plate-shaped member, such that the tube is secured to the plate-shaped member and a fluid-tight seal is formed therebetween.

3 Claims, 1 Drawing Sheet

PROCESS FOR MAKING A FLUID-TIGHT CONNECTION BETWEEN A TUBE AND A PLATE-SHAPED PART

CROSS REFERENCE TO RELATED APPLICATIONS

This application claims the benefit of International Application No. PCT/EP98/01937, filed Mar. 31, 1998.

BACKGROUND OF THE INVENTION

1. Field of the Invention

The present invention generally relates to a process for making a fluid-tight connection between a tube and a plate-shaped part. More particularly, this invention relates to a process that entails inserting one end of a tube into a correspondingly-sized hole in a plate-shaped part so that the tube end extends beyond the surface of the plate-shaped part, inserting a mandrel into the tube end, and then pressing the mandrel into the tube end while heating the mandrel to a temperature sufficient to soften and deform the tube end, thereby securing the tube to the plate-shaped part.

2. Description of the Prior Art

Such a process is described in EP-A-0 379 701.

There is a permanent need to secure leak proof and strong connections between tubes and plate-shaped parts such as those used in heat exchangers. As used herein, "plate-shaped" part meant to denote any object having at least one portion characterized by a relatively thin wall with a substantially flat surface. Examples are tubes with at least one substantially flat surface, such as headers in heat exchangers, box-like structures to be used as containers, such as gasoline tanks, etc.

It is known to use mechanical expansion of the tube end into the plate-shaped part in order to anchor the tube ends in the header plates. This is especially used in heaters and radiators where resilient gaskets may be used as well in order to obtain the required fluid tight connection. However such arrangements are not sufficiently secure for containment of the heat exchanging fluid such as used in air conditioning arrangements in which higher pressures and fluids having smaller molecules are used than in water-based domestic heaters and radiators. Furthermore, where the said heat exchanger tube is present in a hard temper, it becomes increasingly difficult to obtain a good seal by mechanical expansion alone due to the "spring-back" effect. There is also an increasing risk of splitting the tube if a too high expansion force is applied to such a hard tube.

BRIEF SUMMARY OF THE INVENTION

It is therefor an object of the invention to provide a process for making a fluid tight connection between a tube and a plate-shaped member which has improved characteristics compared to the known processes.

This and other objects are achieved in a process according to the introductory part of the description in that a mandrel is inserted into said tube end, said mandrel comprising a first portion having a cross-section substantially corresponding to the inner cross-section of the tube, a second portion having an increased cross-section and a transition portion between these two portions, in that the tube is maintained in its inserted position while pressing the mandrel into the inserted end of the tube and heating, the mandrel being heated to a temperature at least sufficient to soften the tube material, and this situation is maintained during a time sufficient to deform the tube end on the plate-shaped part.

By using a mandrel according to the invention and applying heat to the mandrel, it becomes possible to provide a connection between the plate-shaped part and the tube which is partly obtained by deformation of the tube over the edge of the hole in the plate-shaped part. This can be achieved easily due to the local annealing of the tube end with minimal risk of splitting the tube and without waste energy by heating only the places where the heat is needed. In this way a fluid-tight and mechanically reliable connection is obtained between the tube and the plate-shaped part.

Preferably the tube and/or the plate-shaped part are made out of aluminum or an aluminum-alloy. This type of material is especially effective in heat transfer applications and can be easily deformed at lower temperatures. Due to the spring-back effects from the mechanical deformation, if might be necessary to seal the tube to the plate shaped member by a more secure method, such as by using a brazing connection.

Present brazing techniques for aluminum utilize Al:Si alloys for achieving a brazed joint, usually by use of clad sheet. This is a fairly high temperature operation, well above the temperature at which aluminum alloys become annealed and softened. Therefor, heating of the whole of the assembly plate-shaped part and tube to effect a braze would soften the tube and the part so that deformation of the assembly is likely to occur under normal service conditions where high internal pressures can be encountered.

Localized heating such as used when flame brazing is not feasible or is difficult to realize due to geometrical restrictions and the possibility of heat application outside the desired region.

According to the invention, use is made of the plate-shaped or extruded part which is at least partly coated with a brazing and/or flux material.

In this way it becomes possible to heat the assembled tube and plate-shaped part through the heated mandrel in order to obtain a brazed connection between the two parts to be joined.

If needed only the area around the hole of the plate-shaped or extruded part which needs to be connected to the tube may be provided with such a coating.

An advantageous coating material is zinc, allowing to reduce the temperature of the joining process substantially as zinc will melt and diffuse into the aluminum and form a reliable brazing material at low temperatures.

The invention also relates to a process for making a fluid-tight connection between a header and a number of aluminum tubes coated with brazing and/or flux material, for making a heat exchanger, wherein the header at least comprises a plate-shaped member.

Heat exchangers require a substantial number of connections to be made between a header and a number of tube ends in order to provide the flow channels. Obtaining a reliable fluid-tight connection between the header and the tube ends is still a cumbersome operation, and most failures in this type of heat exchanger occur at the connection between the tube ends and the header. This is partly due to the fact that joints place between the header and the tubes are difficult to reach as a result of the number of tubes and the fins already arranged around the tubes. This can result in unsound brazed joints.

It is therefor also an object of this invention to provide a process whereby the making of the connection between the header and the tubes is substantially improved and facilitated.

This object is obtained in that the connection between each tube and the plate-shaped member of the header is made in accordance with the invention and the plate-shaped member is subsequently modified into a header.

In this way it becomes possible to make a number of connections between tubes and the plate-shaped member of the header in one operation by using the required number of mandrels, and without overheating the already partly assembled heat exchanger, thereby avoiding unwanted deformation of the assembled unit.

The transformation of the plate-shaped member into a header can be easily done either by deformation of the plate-shaped member so that a closed tube-like header is obtained which can easily and reliably be made fluid-tight by brazing, as the joint can be made at an easily accessible place. Otherwise it is possible to make the header by adding another unit to the plate-shaped member and sealing the connection edges between the member and the added unit, thereby providing a tube-like header.

Other characteristics and advantages of the invention will become clear from the following description reference being made to the annexed drawings.

DETAILED DESCRIPTION OF THE INVENTION

Figure 1:
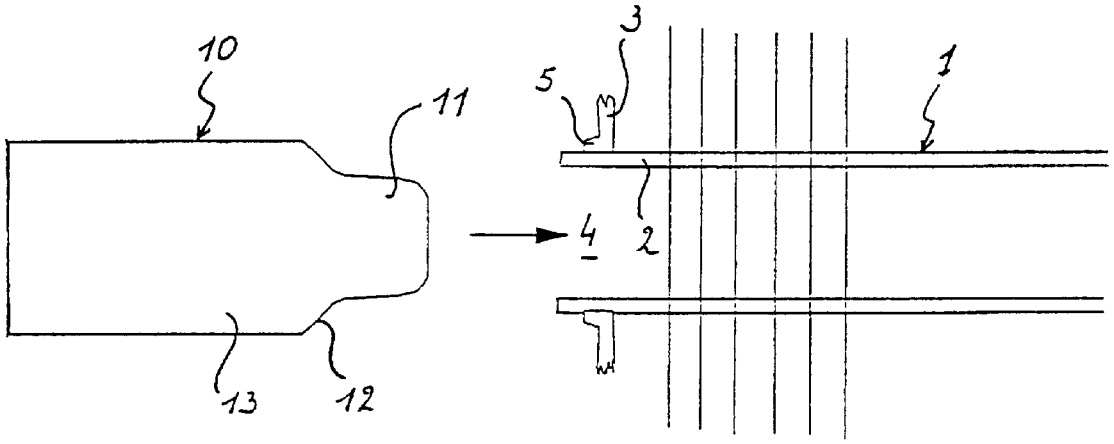
FIG. 1 is a schematic view of a tube and plate-shaped member before assembly.

In FIG. 1 there is shown the end portion 2 of a tube 1 which should be connected in a fluid-tight manner to a plate-shaped part 3. The plate-shaped part 3 may be any wall-like portion of a unit to be used as a fluid container or a fluid transport conduct. The only requirement for the application of the invention is that both sides of the plate-shaped part are accessible for handling purposes as will be elucidated below.

In order to connect the tube end 2 in a fluid-tight manner with the plate-shaped part 3, a hole 4 has been made in the plate-shaped part 3, which hole 4 can be made in any conventional way. According to the invention it is however preferred to making the hole 4 by punching whereby a protruding rim 5 is formed around the hole 4 thereby providing a bigger contact surface between the tube end 2 and the part 3. The dimensions of the tube end 2 and the hole 4 are selected in such a way that as seen in cross-section the shape of the hole 4 substantially corresponds to the shape of the tube end 2, while allowing some clearance between the tube end 2 and the hole 4 after the tube end 2 has been inserted in the hole 4.

Figure 2:
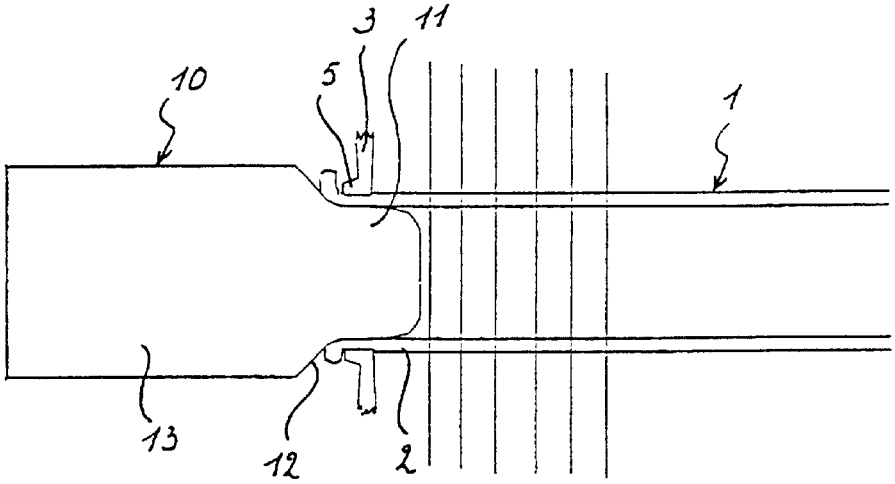
FIG. 2 is a corresponding view during the assembling of the two parts.

After having prepared the hole 4 in that way, the tube end 2 is inserted into the hole 4 up to a defined depth and is temporarily fixed in this position by any suitable clamping means. While maintained in that position a mandrel 10 may be moved into the open end 2 of the tube 1. In case the tube 1 is used in a heat exchanger wherein the tube is surrounded by fins as shown in FIGS. 1 and 2, the expansion of the tube in order to give it a close contact with the fins can be performed simultaneously with the above cited expansion of the tube end 2.

The mandrel 10 is fixed to any suitable moving means (not shown) for inserting the mandrel 10 into the tube end 2 will sufficient force to generate the deformation to be obtained as explained below. The mandrel 10 itself consists in fact of three parts, a first part or guiding part 11, a second of transition part 12 and a third or bay part 13. The guiding part 11 has a cross-section which is substantially equal to the internal cross-section of the tube end 2, in such a way that the free end portion (leading part) has dimensions which gradually increase toward its trailing part i.e. the part which is connected to the conical part 12. In the conical part 12 the dimensions of the cross-section gradually increase to dimensions such that the cross-section is larger than the cross-section of the tube end 2.

The mandrel 10 can be made of material such as a stud, and it may be completely solid, such as shown in FIG. 1, or it may be partly hollow, so that heating means can be incorporated inside the mandrel 10.

Preferably the tube 1 and the plate-shaped part 3 are made out of aluminum or an aluminum-alloy.

The operation of the system according to the invention is clearly shown in FIG. 2 While maintaining the tube 1 in a fixed position the mandrel 10 is inserted with sufficient force into the tube end 2.

By this force the tube end 2 is deformed initially by expansion, as a result of the shape of this guiding part 11 of the mandrel 10, and at the end of the insertion by deformation of the edge around the rim 5 of the hole 4. As a result of these deformations a reliable mechanical connection has been obtained.

In order to reduce the forces to be used and to reduce the risk for damage during deformation the mandrel 10 may be heated, either directly by some suitable heating means provide inside the mandrel 10 itself or its supporting means, or indirectly, i.e. the mandrel 10 is preheated and its heat content is used during the insertion.

The use of a heated mandrel, promotes the ability to generate a brazed connection between the tube end 2 and the rim 5 of the hole 4, especially in case aluminum parts are used. For that purpose, some brazing material must be present on the surface of at least one of the parts, i.e. either on the tube end 2, or on the hole edge 4 or on both. For that reason there might be applied a filler to the aluminum surface of one or both parts, such as a zinc clad. The application of a flux may be superfluous as due to the mechanical deformation the oxide layer on the aluminum surface is cracked sufficiently to allow brazing . Otherwise it is also possible to apply a flux to one or both surfaces to be joined, in order to improve the joint.

By combining the mechanical deformation and a brazing effect, an improved joint will be obtained providing a better guarantee against fluid leakage, especially in high pressure application such as heat exchangers.

While the invention has been described in terms of a preferred embodiment, it is apparent that other forms could be adopted by one skilled in the art. Accordingly, the scope of the invention is to be limited only by the following claims.

What is claimed is:

1. A process for assembling a heat exchanger, the process comprising the steps of:

forming a plurality of holes in an aluminum header of a heat exchanger so as to form a protruding rim surrounding each of the holes on a first side of the header;

inserting an aluminum tube into each of the holes so that an end of each of the tubes contacts the header and projects beyond the first side of the header, each of the tubes having an internal passage and an outer perimeter that mates with a corresponding one of the holes;

inserting mandrels into the ends of the tubes, each of the mandrels comprising a first portion having a cross-section substantially corresponding to the internal passage of the tube, a second portion having a cross-section greater than the first portion, and a transition portion between the first and second portions;

maintaining the ends of the tubes in the holes while pressing the mandrels into the ends and heating the mandrels to a temperature at least sufficient to soften the tubes; and continuing to press and heat the mandrels for a time sufficient to deform the ends of the tubes and increase contact between the tubes and the header, the increased contact securing the tubes to the header and forming a fluid-tight seal therebetween;

wherein at least one of the tubes and a surface of the header surrounding the at least one tube is coated with a brazing material, an oxide layer on each of the ends of the tubes is cracked during deforming of the ends, and heating the ends of the tubes with the mandrel causes the tubes to become brazed to the header without use of a flux material.

2. A process according to claim 1, wherein at least one of the tubes and a surface of the header surrounding the at least one tube is coated with at least one material chosen from the group consisting of brazing materials and flux materials.

3. A process according to claim 1, wherein the brazing material comprises zinc.

* * * * *